US008616723B2

(12) United States Patent
Zhang et al.

(10) Patent No.: US 8,616,723 B2
(45) Date of Patent: Dec. 31, 2013

(54) FLUORESCENCE-LIKE LED ILLUMINATION UNIT AND APPLICATIONS THEREOF

(75) Inventors: Wenhu Zhang, Shanghai (CN); Qiuhua Zheng, Shanghai (CN)

(73) Assignee: Shanghai Cata Signal Co., Ltd., Shanghai (CN)

( * ) Notice: Subject to any disclaimer, the term of this patent is extended or adjusted under 35 U.S.C. 154(b) by 71 days.

(21) Appl. No.: 13/510,513

(22) PCT Filed: Jan. 10, 2011

(86) PCT No.: PCT/CN2011/000043

§ 371 (c)(1),
(2), (4) Date: May 17, 2012

(87) PCT Pub. No.: WO2011/085638

PCT Pub. Date: Jul. 21, 2011

(65) Prior Publication Data

US 2012/0230044 A1 Sep. 13, 2012

(30) Foreign Application Priority Data

Jan. 15, 2010 (CN) ..... 2010 1 0005202

(51) Int. Cl.
*F21V 33/00* (2006.01)

(52) U.S. Cl.
USPC .. 362/218; 362/254; 362/249.02; 362/311.02

(58) Field of Classification Search
USPC ..... 362/218, 219, 223, 254, 294, 249.02, 362/311.02, 373
See application file for complete search history.

(56) References Cited

U.S. PATENT DOCUMENTS

| | | | | |
|---|---|---|---|---|
| 8,376,579 | B2 * | 2/2013 | Chang | 362/249.02 |
| 2009/0290334 | A1 * | 11/2009 | Ivey et al. | 362/219 |
| 2011/0141724 | A1 * | 6/2011 | Erion | 362/218 |
| 2011/0292647 | A1 * | 12/2011 | Chang | 362/218 |
| 2012/0051039 | A1 * | 3/2012 | Chang | 362/218 |
| 2012/0106144 | A1 * | 5/2012 | Chang | 362/218 |

* cited by examiner

*Primary Examiner* — Laura Tso
(74) *Attorney, Agent, or Firm* — John P. White; Cooper & Dunham LLP

(57) ABSTRACT

A fluorescence-like light emitting diode (LED) illumination unit is provided, which includes a radiator, an LED substrate fixed on the radiator, and multiple LED illuminants encapsulated on the LED substrate. A first surface of the radiator is in the shape of a paraboloid with reflective effect. A bar-shaped convex lens with radial converging effect is disposed in the space surrounded by the paraboloid. The bar-shaped convex lens is located in front of the multiple LED illuminants and radially converges part of light rays emitted by the multiple LED illuminants but axially diffuses them. The illumination unit completely solves the problems such as exposure of spotted light sources, small irradiation angle of a light path, beaded light spots of the LED light sources as the lamp illuminant, visual dizziness caused by multiple projections formed by irradiating an irradiated object with a multi-point light source, dazzling light rays, and the like in an existing LED illumination lamp. The illumination unit emits more uniform and soft light rays, with a higher brightness in an irradiated region and a light emitting mode which is basically not different from that of a conventional daylight lamp, and meets the long-term using habit and approval of people. Various applications of the fluorescence-like LED illumination unit are further provided.

20 Claims, 11 Drawing Sheets

FLUORESCENCE-LIKE LED ILLUMINATION UNIT AND APPLICATIONS THEREOF

CROSS-REFERENCE TO RELATED APPLICATIONS

This application is a §371 national stage of PCT International Application No. PCT/CN2011/000043, filed Jan. 10, 2011, claiming priority of Chinese Patent Application No. 201010005202.7, filed Jan. 15, 2010, the contents of each of which are hereby incorporated by reference in their entirety.

BACKGROUND OF THE INVENTION

1. Field of Technology

The present invention relates to a light emitting diode (LED) illumination/signal lamp, and, more particularly, to a LED illumination unit which is similar to, even better than, a conventional daylight lamp in fluorescent effect. The present invention further relates to the application of the fluorescence-like LED illumination unit.

2. Background

Compared with conventional illumination lamps, such as, incandescent lamps and daylight lamps, LED illumination lamps are characterized by long service life, high light efficiency, low power consumption, no fluorescent dye contamination, and so on, and are easily replaced. However, for existing LED lamp tubes for illumination, a circuit board and a LED array are disposed in the tube body of the lamp tube, LED illuminants are generally arranged in an axial direction of the tube body, and light emitting centers of the LED illuminants face a tube wall of the tube body. Such LED daylight lamps have problems such as, exposure of spotted light sources, small irradiation angle of the light path, string of bead-like LED spotted light sources forming the daylight lamp, dazzling light rays, significant difference from a light emitting mode of existing daylight lamps, and dizziness caused by multiple overlapping projections formed on the wall or ground by irradiating an irradiated object with multiple light spots. These LED daylight lamps fail to meet people's long-term use experience of conventional daylight lamps, have low comfortability, and thus are not suitable for domestic illumination.

To make the light emitting mode of the LED illumination lamps be close to that of the existing daylight lamps, many inventors are devoted to the research of the light emitting mode of the LED illumination lamps and produce many patents.

For example, a typical solution is to dispose two LED illuminants in opposite directions at two ends of an LED lamp tube and dispose a double-sided reflective sheet or light guide material or light reflecting material in the tube body, so that light emitted by the LED illuminants are reflected through the double-sided reflective sheet or the light reflecting material or scattered through the light guide material, so as to approximate the light emitting mode of the existing daylight lamps. Such a typical solution is, for example, an LED daylight lamp disclosed in Chinese Invention Patent Publication No. CN101144591A, an LED daylight lamp disclosed in Chinese Utility Model Patent Granted Publication No. CN200993322Y, or the like. However, such LED daylight lamps use a small number of LED illuminants with low illumination intensity, and thus are difficult to be used for daily illumination.

Another typical manner is to mix a certain amount of light scattering powder or light guide powder into the raw material of a PC or PV lamp tube uniformly during injection molding of the lamp tube and to form a hollow lamp tube by injection molding, so that light emitted by LED illuminants is transmitted through the PC or PV lamp tube. Such a patent is, for example, a soft LED daylight lamp with multiple light emitting angles disclosed in Chinese Utility Model Patent Granted Publication No. CN201293218Y. However, such an LED daylight lamp still can not solve the problems such as exposure of spotted light sources, large light path loss, and low illumination intensity in LED daylight lamps.

Still another typical manner is to use LED illuminants with lenses added therein, for example, a high-power LED daylight lamp disclosed in Chinese Utility Model Patent Granted Publication No. CN201330956Y. However, such an LED daylight lamp still can not solve the above relevant problems existing in LED daylight lamps well.

SUMMARY OF THE INVENTION

To solve the above technical problems existing in LED daylight lamps, the present invention is directed to a LED illumination unit more similar to a conventional fluorescent lamp and illumination lamps manufactured by using the LED illumination unit and suitable for domestic use, which have light color, light emission uniformity, and softness basically not different from those of the existing fluorescent lamps, and meet the long-term using habit and approval of people. According to the definition of light utilization efficiency, since emitted light of an optical model used by the LED illumination unit in the present invention has a certain directivity, the ratio of luminous flux in the illuminated effective area to light source luminous flux is high, so that the lamps have a higher light utilization efficiency than that of the conventional fluorescent lamps. The technical problems to be solved by the present invention may be implemented through the following technical solutions.

Said technical problems can be resolved by the following solutions:

A fluorescence-like LED illumination unit is provided, which includes a radiator, an LED substrate fixed on an inner surface of the radiator and extending axially along the radiator, and multiple LED illuminants arranged axially along the radiator and encapsulated on the LED substrate, in which the inner surface of the radiator is in the shape of a paraboloid with reflective effect; a bar-shaped convex lens with radial converging effect is disposed in the space surrounded by the paraboloid with reflective effect on the inner surface of the radiator; the bar-shaped convex lens is located in front of the multiple LED illuminants and extends axially along the radiator; and the bar-shaped convex lens radially converges part of light rays emitted by the multiple LED illuminants but axially diffuses them.

The bar-shaped convex lens is located near a location in front of the LED illuminants with light converging effect for the LED illuminants.

The fluorescence-like LED illumination unit of the present invention further includes a light distribution lampshade connected to the radiator and located in front of the bar-shaped convex lens.

The bar-shaped convex lens is a bar-shaped light converging Fresnel lens.

The light distribution lampshade of the present invention is a transparent lampshade, or a mist-like soft light lampshade, or a light distribution lampshade having various straight or irregular stripes with light scattering effect distributed on inner and outer surfaces thereof, or any other dedicated light distribution lens so that the fluorescence-like LED illumination unit becomes LED signal lamps with other functions.

In the present invention, heat dissipation fins are disposed on an outer surface of the radiator to improve a heat dissipation effect.

In the present invention, multiple mounting posts are disposed in a spaced arrangement axially along the radiator on the inner surface of the radiator, and the bar-shaped light converging convex lens is fixedly mounted on the mounting posts by screws or other means.

In the present invention, a strip-shaped mounting groove for embedding the LED substrate is disposed on the inner surface of the radiator, the LED substrate is embedded in the strip-shaped mounting groove, and the multiple mounting posts are arranged in the strip-shaped mounting groove.

The LED illuminants in the present invention may be high-power patch LEDs or conventional low-power in-line LEDs required for corresponding colors according to different lamp functions, or bat-shaped light distribution LEDs, or LED illuminants equipped with other special lenses; the LED illuminants may be single-chip LEDs or multi-chip LEDs.

The fluorescence-like LED illumination unit of the present invention may be used as an LED daylight lamp, the radiator and the light distribution lampshade of the LED daylight lamp define and form a circular lamp tube, lamp holders are mounted on two ends of the circular lamp tube, the lamp holder has electrodes connected to an external power source, the LED substrate is electrically connected to the electrodes on the lamp holders; slots for mounting the light distribution lampshade are disposed on two sides of the strip-shaped mounting groove, insertion edges are disposed on two axial sides of the light distribution lampshade, and the insertion edges are inserted into the slots from one end of the radiator, so that the light distribution lampshade and the radiator are connected to form the lamp tube.

The fluorescence-like LED illumination unit in the present invention may be used as a warning lamp light emitting unit, the radiator of the warning lamp light emitting unit is of a plate-like structure, a bar-shaped reflective bowl is disposed on the inner surface of the radiator, an inner surface of the bar-shaped reflective bowl is in the shape of a paraboloid with reflective effect; the light distribution lampshade is of a basket-shaped structure, a pressed edge is arranged on the periphery of the light distribution lampshade, and the pressed edge is pressed and connected on the radiator by a pressing ring; and a sealing strip for sealing a seam between the pressed edge and the radiator is disposed on the pressed edge.

The fluorescence-like LED illumination unit of the present invention may be used as a beacon lamp (pharos) light emitting unit, the radiator of the beacon lamp light emitting unit is of a plate-like structure, a bar-shaped reflective bowl is disposed on the inner surface of the radiator, an inner surface of the bar-shaped reflective bowl is in the shape of a paraboloid with reflective effect; the light distribution lampshade is of a basket-shaped structure, a pressed edge is arranged on the periphery of the light distribution lampshade, and the pressed edge is pressed on the radiator by a pressing ring; and a sealing strip for sealing a seam between the pressed edge and the radiator is disposed on the pressed edge.

The beacon lamp light emitting unit may be used for manufacturing a beacon lighthouse lamp, the beacon lighthouse lamp includes a base and a beacon lamp light emitting unit fixing frame fixed on the base, and multiple beacon lamp light emitting units may exist according to requirements of different sight distances, and are fixed on the beacon lamp light emitting unit fixing frame in an annular arrangement with multiple layers.

The fluorescence-like LED illumination unit of the present invention may be used for manufacturing a car decorative illumination lamp or household ceiling lamp, the car decorative illumination lamp or household ceiling lamp includes a basket-shaped lamp housing, multiple fluorescence-like LED illumination units exist, the multiple fluorescence-like LED illumination units are arranged in the lamp housing, and the light distribution lampshade is mounted at an opening of the lamp housing.

The fluorescence-like LED illumination unit of the present invention may be used for manufacturing a road lamp light emitting unit, the radiator of the road lamp light emitting unit is of a plate-like structure, the light distribution lampshade is of a basket-shaped structure, a pressed edge is arranged on the periphery of the light distribution lampshade, and the pressed edge is pressed on the radiator by a pressing ring; and a sealing strip for sealing a seam between the pressed edge and the radiator is disposed on the pressed edge.

With the above technical solutions, through a combination of a bar-shaped convex lens having radial light converging effect but blending greatly diffused light in the axial direction and a paraboloidal reflective mirror together with improvements to a light distribution lampshade, the present invention completely solves the problems such as exposure of spotted light sources, small irradiation angle of a light path, beaded LED light sources forming the illuminant, dazzling light rays, and the like in an existing LED illumination lamp, especially, an LED daylight lamp. The illumination unit emits more uniform and soft light rays, with a higher brightness in an irradiated region and a light emitting mode which is basically not different from that of a conventional daylight lamp, and meets the long-term using habit of people. In addition, the light efficiency of lamps is greatly improved by disposing the bar-shaped convex lens with radial converging effect. Upon preliminary detection, a fluorescence-like LED illumination lamp of 8 W achieves a ground illumination of 120-150 lux when having a vertical distance of 2.5 m from the ground.

The present invention is further illustrated below with reference to accompanying drawings and specific embodiments in the specification.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

To make the technical means, features, purposes, and effects of the present invention comprehensible, the present invention is further elaborated below with reference to specific embodiments and drawings.

Embodiment 1

Figure 1:
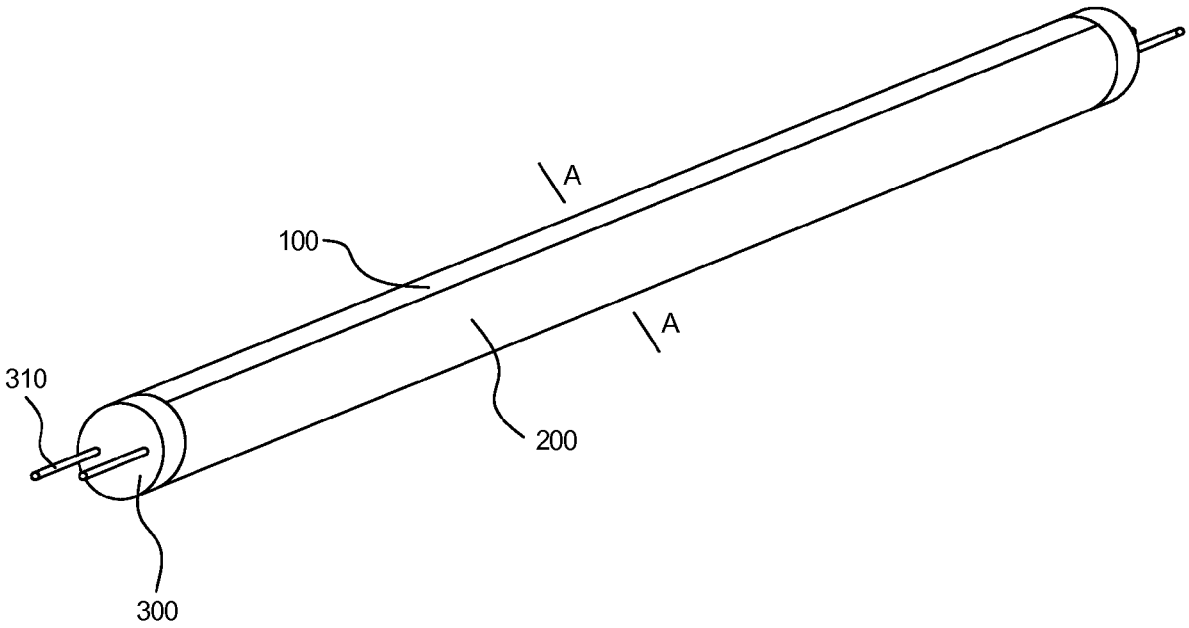
FIG. 1 is a schematic structural view of an LED daylight lamp in the present invention.

Referring to FIG. 1, a fluorescence-like LED daylight lamp of the present invention includes a lamp tube formed by an axial radiator 100, a bar-shaped light converging Fresnel lens 500, and a light distribution lampshade 200, in which the radiator 100 is made of an aluminium alloy material. Lamp holders 300 are mounted on two ends of the lamp tube, and the lamp holder 300 has electrodes 310 thereon.

Figure 2:
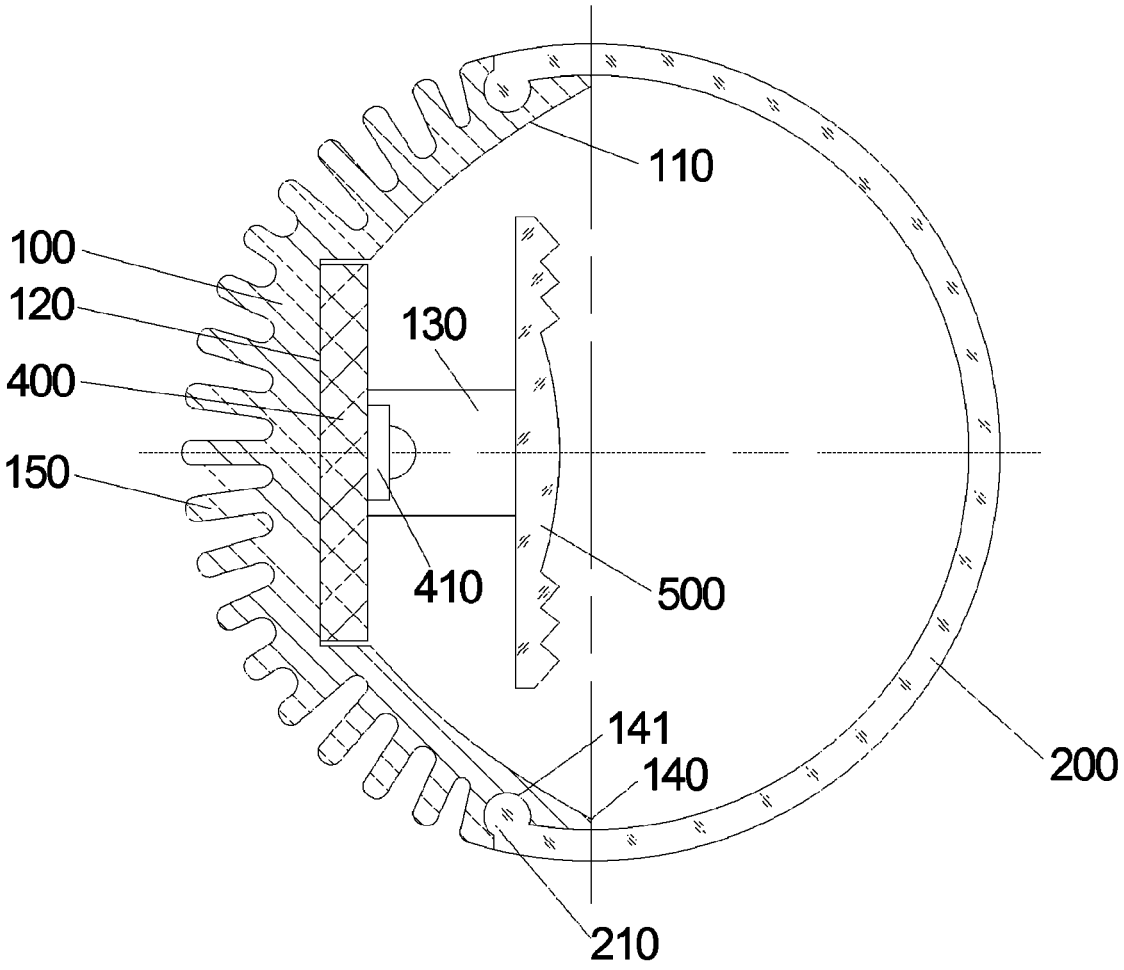
FIG. 2 is an A-A sectional view of FIG. 1.

Referring to FIG. 2, an inner surface 110 of the radiator 100 is a paraboloid with reflective effect so as to reflect part of light emitted by LED illuminants 410. A strip-shaped mounting groove 120 for embedding an LED substrate 400 is disposed on the inner surface 110 of the radiator 100, the LED substrate 400 is mounted in the strip-shaped mounting groove 120, and a heat conductive adhesive is used on a bonding surface between the LED substrate 400 and the radiator 100 for heat conduction. The LED substrate 400 is electrically connected to the electrodes 310 fixed on the lamp holders 300 and extends axially along the radiator 100. The LED substrate 400 may be one piece or formed by multiple pieces connected in series.

Multiple LED illuminants 410 are encapsulated on the LED substrate 400. The LED illuminants 410 are preferably high-power patch LEDs currently commercially available, and may also be conventional low-power in-line LED illuminants according to different energy configuration requirements of lamps.

On the inner surface 110 of the radiator 100, multiple mounting posts 130 may be disposed in a spaced arrangement axially along the radiator 100 in the strip-shaped mounting groove 120, and the bar-shaped light converging Fresnel lens 500 radially converging light but blending greatly diffused light axially is fixed on the mounting posts 130 by screws or other means. The bar-shaped Fresnel lens 500 radially converging light but blending greatly diffused light axially not only can converge light but also can eliminate obvious light spots, which, together with the light distribution lampshade 200 having mist-like soft light or any other light distribution lampshade 200 having various straight or irregular stripes with light scattering effect distributed on inner and outer surfaces thereof, can completely solve the problems such as exposure of spotted light sources, small irradiation angle of a light path, overlapping projections formed by irradiation with a multi-point light source, dazzling light rays, and the like in the existing LED daylight lamp, and further improve the uniformity and softness of light.

A slot 141 axially extending along the radiator 100 is respectively opened at end portions of two free ends 140 of the radiator 100, and insertion edges 210 are disposed on two sides of the light distribution lampshade 200. The insertion edges 210 are inserted into the slots 141 from one end of the radiator 100 so as to combine the light distribution lampshade 200 with the radiator 100 to form the entire lamp tube of the fluorescence-like LED illumination lamp. The light distribution lampshade 200 of the present invention may also be a milky white lampshade or frosted lampshade with a light diffusing agent added therein. Certainly, the light distribution lampshade 200 of the present invention may also be a transparent diffusion light distribution lampshade with straight stripes. For example, the purpose of the present invention can also be achieved by using a transparent light distribution lampshade with diffusion particles or irregular stripes.

To improve the heat dissipation effect of the radiator 100, heat dissipation fins 150 are disposed on the outer surface of the radiator 100.

Embodiment 2

Figure 3A:
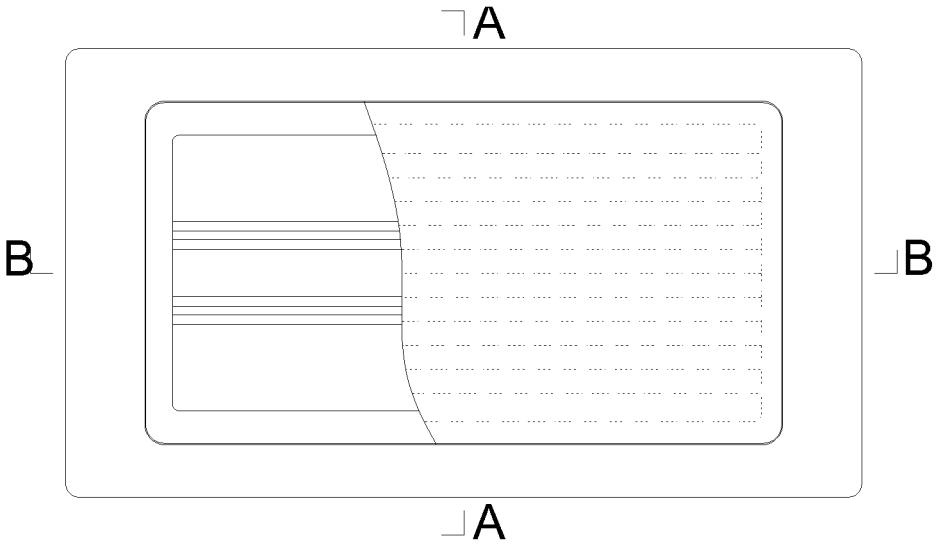
FIG. 3*a* is a schematic front view of a warning lamp light emitting unit in the present invention.
Figure 3B:
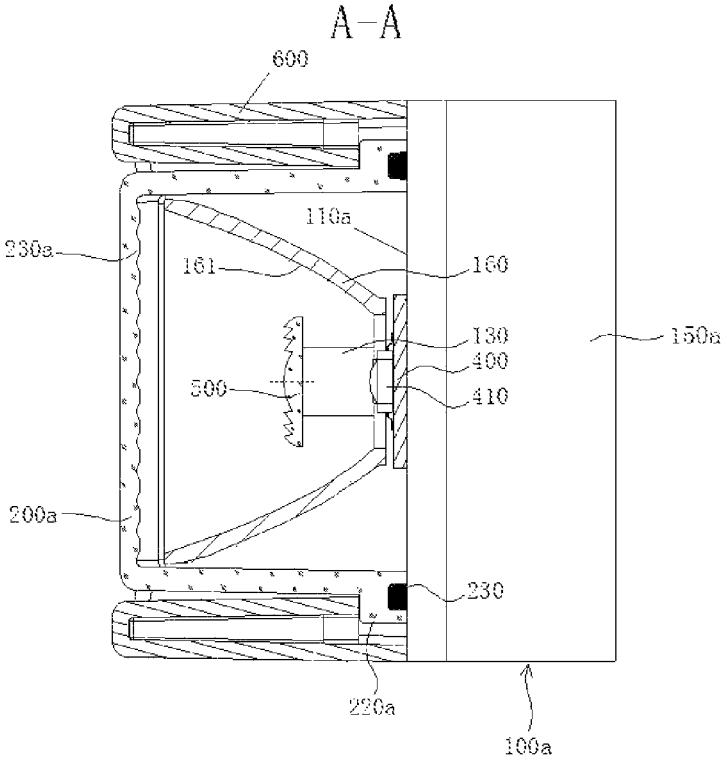
FIG. 3*b* is an A-A sectional view of FIG. 3*a;*
Figure 3C:
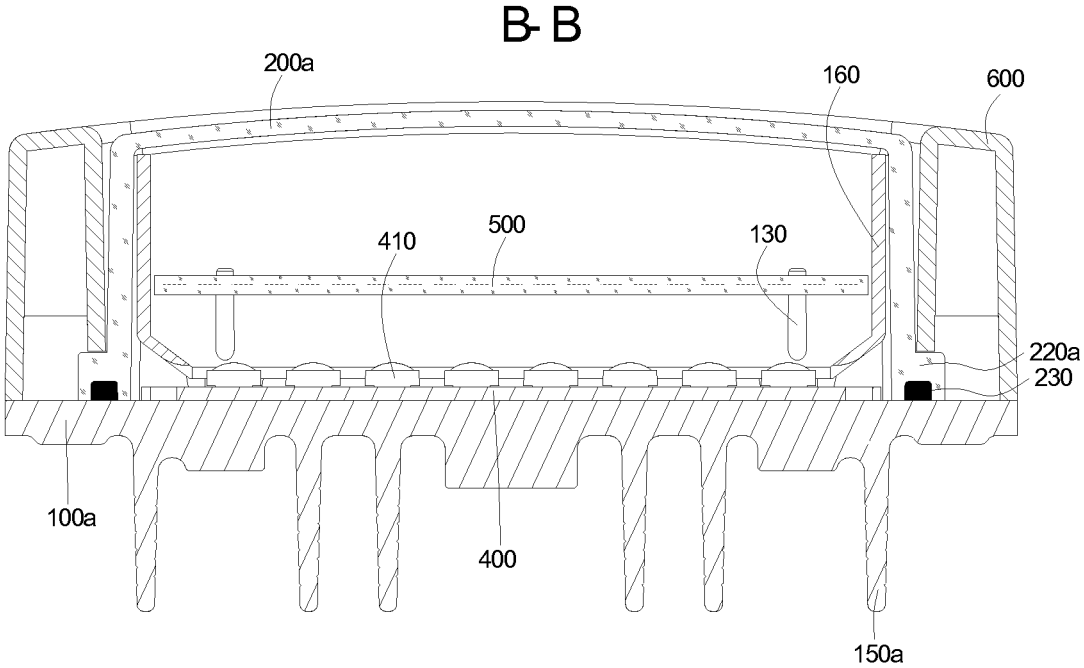
FIG. 3*c* is a B-B sectional view of FIG. 3*a;*

Referring to FIG. 3*a* to FIG. 3*c*, a warning lamp light emitting unit of the present invention is formed by a plate-like radiator 100*a*, a bar-shaped light converging Fresnel lens 500, a LED substrate 400, and a light distribution lampshade 200*a*. The plate-like radiator 100*a* is made of an aluminium alloy material. A bar-shaped reflective bowl 160 is mounted in an axial direction of the radiator 100 and on an inner surface 110*a* of the plate-like radiator 100*a*, and an inner surface of the bar-shaped reflective bowl 160 is a paraboloid 161 with reflective effect. The LED substrate 400 is mounted on the inner surface 110*a* of the plate-like radiator 100*a*, and a heat conductive adhesive is used on a bonding surface between the LED substrate 400 and the inner surface 110*a* of the plate-like radiator 100*a* for heat conduction.

The LED substrate 400 extends axially along the radiator 100*a*, and the LED substrate 400 may be one piece or formed by multiple pieces connected in series. Multiple LED illuminants 410 are encapsulated on the LED substrate 400. The LED illuminants 410 are preferably high-power patch LEDs currently commercially available, and may also be conventional low-power in-line LED illuminants according to different energy configuration requirements of lamps. On the inner surface 110*a* of the radiator 100*a*, multiple mounting posts 130 are disposed in a spaced arrangement axially along the radiator 100*a*, and the bar-shaped light converging Fresnel lens 500 is fixed on the mounting posts 130 by screws. The bar-shaped Fresnel lens 500 radially converging light but blending greatly diffused light axially not only can converge light but also can eliminate obvious light spots, which, together with light distribution lampshades 200*a* of different light distribution performance or different colors, for example, the light distribution lampshade 200*a* having appropriate arc stripes 230*a* arranged thereon, can accurately control the light distribution requirement of a warning lamp in the vertical direction as required, in which the high luminous intensity, large view angle in the horizontal direction, and efficiency of the warning lamp far exceed those of LED warning lamp products of the same kind. The light distribution lampshade 200*a* is of a basket-shaped structure. A pressed edge 220*a* is arranged on the periphery of the light distribution lampshade 200*a*, and the pressed edge 220*a* is pressed and connected on the radiator 100*a* by a pressing ring 600; a sealing strip 230 for sealing a seam between the pressed edge 220*a* and the radiator 100*a* is disposed on the pressed edge 220*a* for preventing water from entering the light distribution lampshade 200*a*.

To improve the heat dissipation effect of the radiator 100*a*, heat dissipation fins 150*a* are disposed on the outer surface of the radiator 100*a*.

Embodiment 3

Figure 4A:
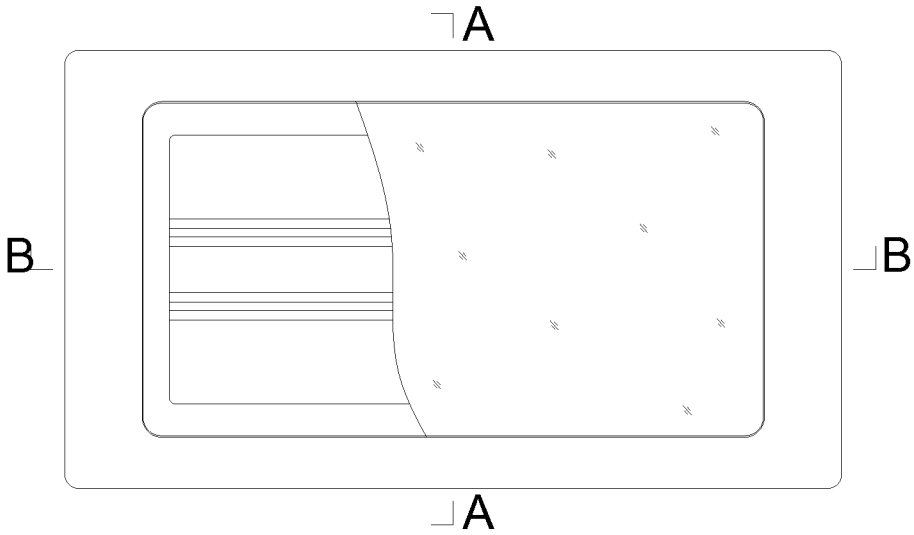
FIG. 4*a* is a schematic front view of a beacon lamp light emitting unit in the present invention.
Figure 4B:
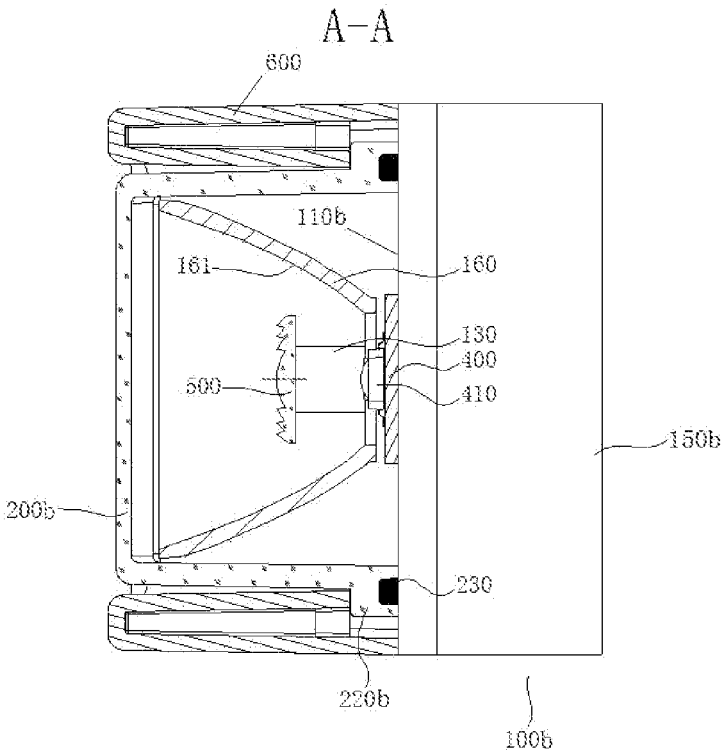
FIG. 4*b* is an A-A sectional view of FIG. 4*a;*
Figure 4C:
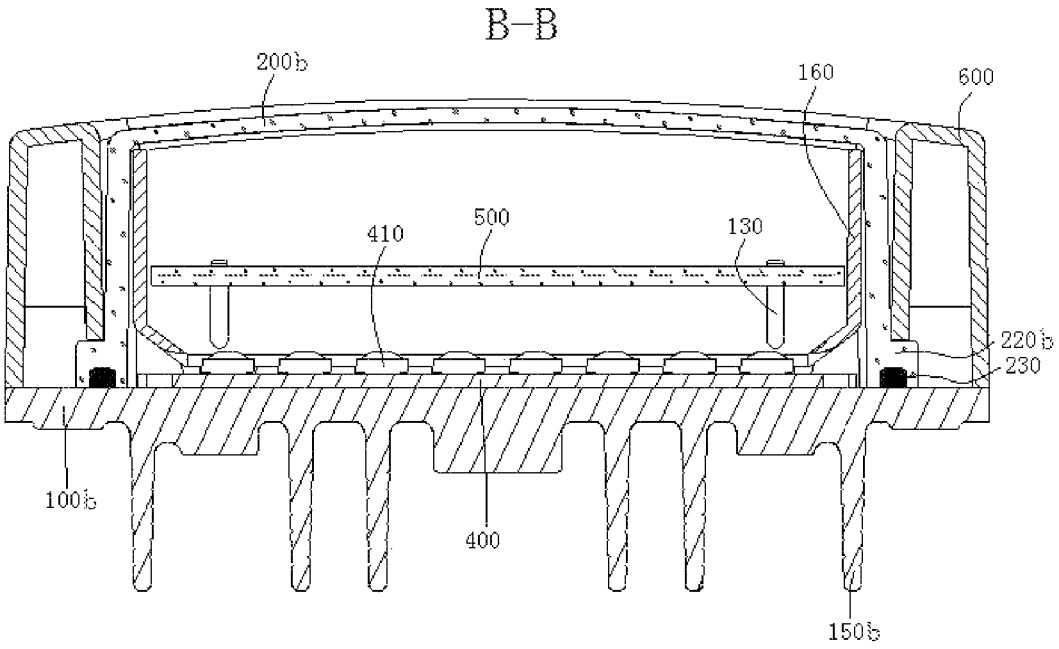
FIG. 4*c* is a B-B sectional view of FIG. 4*a;*

Referring to FIG. 4*a* to FIG. 4*c*, a beacon lamp light emitting unit of the present invention is formed by a plate-like radiator 100*b*, a bar-shaped light converging Fresnel lens 500, an LED substrate 400, and a light distribution lampshade 200*b*. The plate-like radiator 100*b* is made of an aluminium alloy material. A bar-shaped reflective bowl 160 is mounted in an axial direction of the radiator 100*b* and on an inner surface 110*b* of the plate-like radiator 100*b*, and an inner surface of the bar-shaped reflective bowl 160 is a paraboloid 161 with reflective effect. The LED substrate 400 is mounted on the inner surface 110*b* of the plate-like radiator 100*b*, and a heat conductive adhesive is used on a bonding surface between the LED substrate 400 and the inner surface 110*b* of the plate-like radiator 100*b* for heat conduction.

The LED substrate 400 extends axially along the radiator 100*b*, and the LED substrate 400 may be one piece or formed by multiple pieces connected in series. Multiple LED illuminants 410 are encapsulated on the LED substrate 400. The LED illuminants 410 are preferably high-power patch LEDs currently commercially available, and may also be conventional low-power in-line (direct insertion) LED illuminants according to different energy configuration requirements of lamps. On the inner surface 110*b* of the radiator 100*b*, multiple mounting posts 130 are disposed in a spaced arrangement axially along the radiator 100*b*, and the bar-shaped light converging Fresnel lens 500 is fixed on the mounting posts 130 by screws. The bar-shaped Fresnel lens 500 radially converging light but blending greatly diffused light axially not only enables a beacon lamp designed in this way to have a small divergence angle in the vertical direction and have high light converging efficiency, but also can increase annular blending of lamplight to improve light emission uniformity of the beacon lamp in the horizontal direction in a ring of 360°, in which the effective view angle, light intensity index, and photoelectric efficiency of the lamp far exceed those of LED beacon lamp products of the same kind. The light distribution lampshade 200*b* is a planar light transmitting lampshade of a basket-shaped structure. A pressed edge 220*b* is arranged on the periphery of the light distribution lampshade 200*b*, and the pressed edge 220*b* is pressed on the radiator 100*b* by a pressing ring 600; a sealing strip 230 for sealing a seam between the pressed edge 220*b* and the radiator 100*b* is disposed on the pressed edge 220*b* for preventing water from entering the light distribution lampshade 200*b*.

To improve the heat dissipation effect of the radiator 100*b*, heat dissipation fins 150*b* are disposed on an outer surface of the radiator 100*b*.

Embodiment 4

Figure 5:
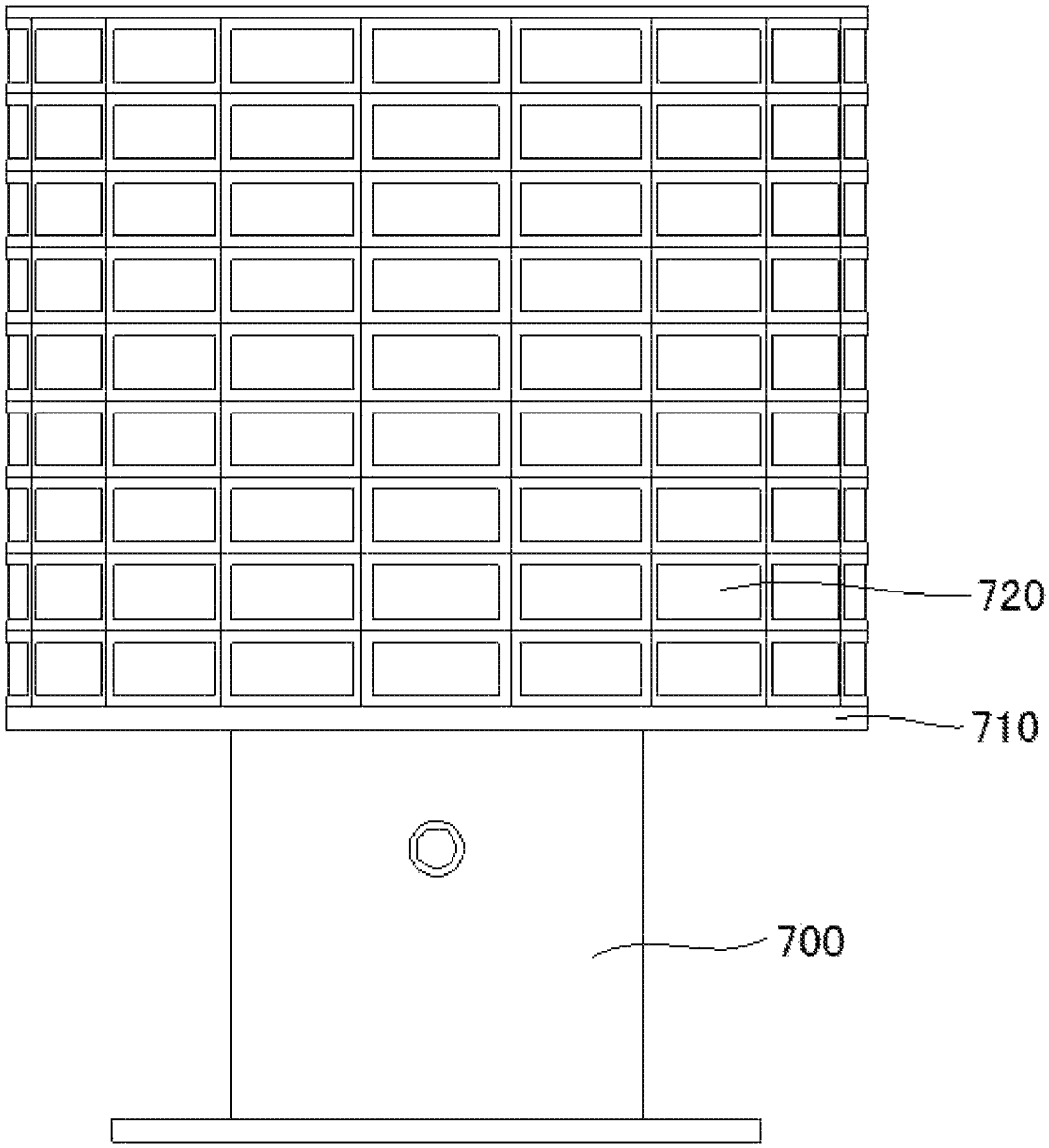
FIG. 5 is a schematic view of a large-scale beacon lighthouse lamp manufactured by using the beacon lamp light emitting unit in the present invention.

Referring to FIG. 5, a large-scale beacon lighthouse lamp with high light intensity shown in FIG. 5 is manufactured by using the beacon lamp light emitting unit shown in FIG. 4*a* to FIG. 4*c*, and has a luminous intensity meeting the requirement of far sight distance of 16-20 sea miles and a luminous efficiency greater than 50 cd/w, thus filling up a gap of LED beacon lamp products of the same kind. The large-scale beacon lighthouse lamp with high light intensity includes a base 700 and a beacon lamp light emitting unit fixing frame 710 fixed on the base 700. Multiple beacon lamp light emitting units 720 may exist according to requirements of different sight distances, and be fixed on the beacon lamp light emitting unit fixing frame 710 in an annular arrangement with multiple layers in the vertical direction.

Embodiment 5

Figure 6A:
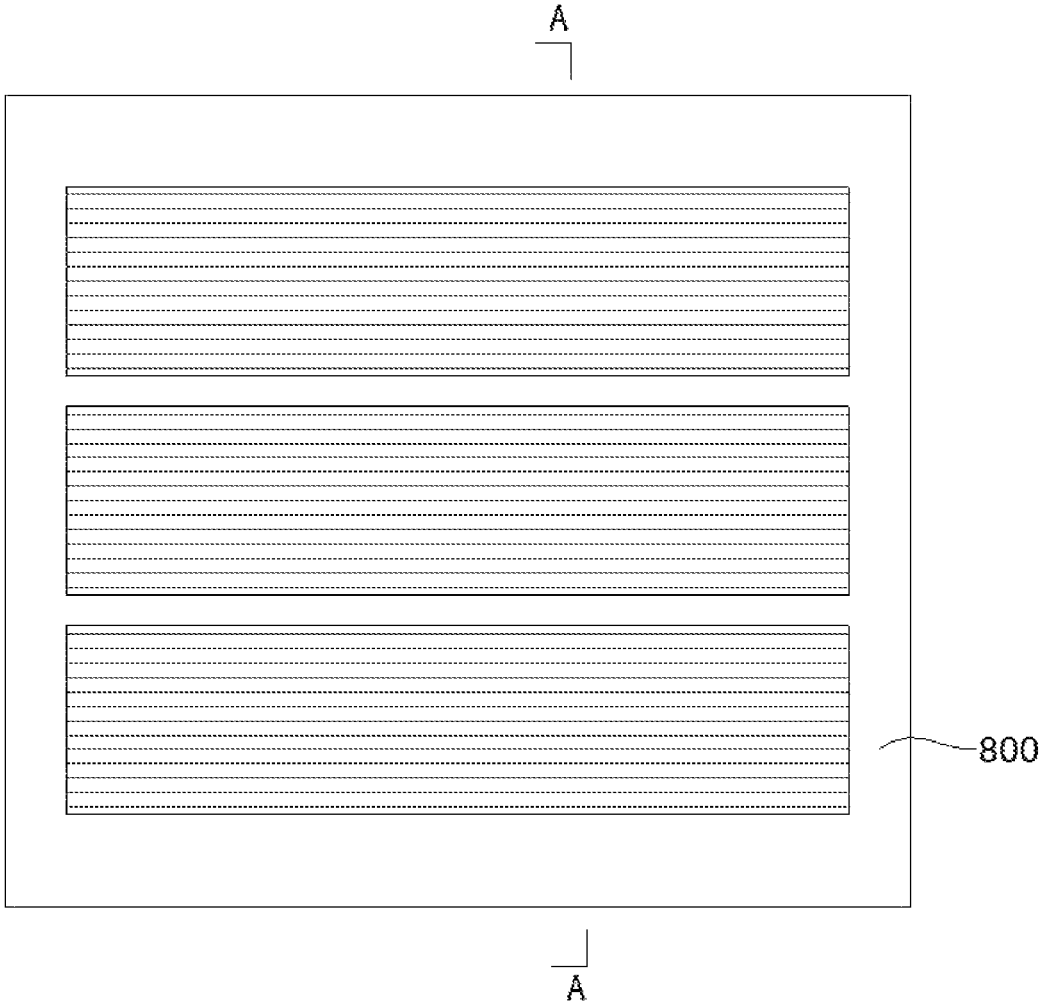
FIG. 6*a* is a schematic front view of a car decorative illumination lamp or ceiling lamp in the present invention.
Figure 6B:
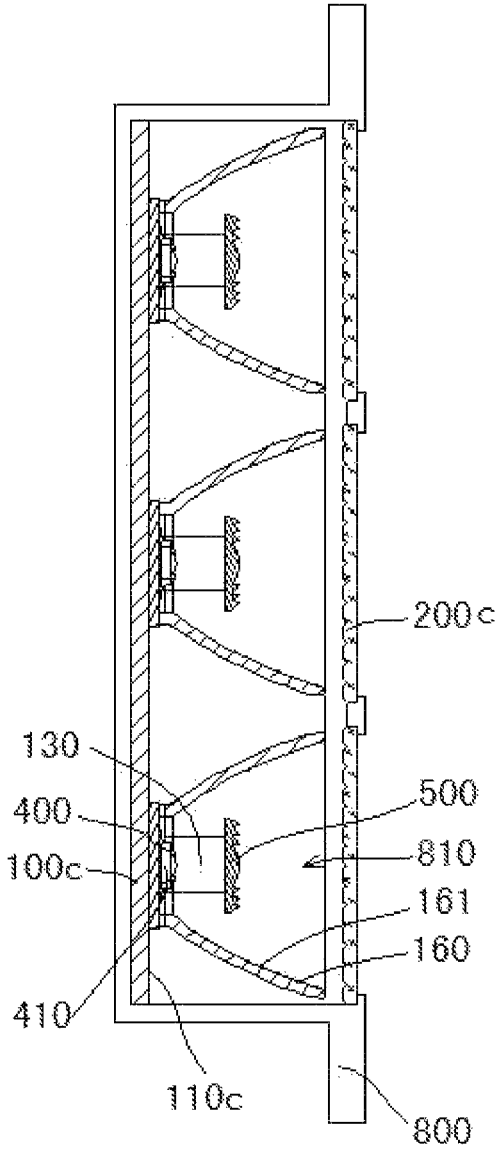
FIG. 6*b* is an A-A sectional view of FIG. 6*a;*

Referring to a car decorative illumination lamp or household ceiling lamp shown in FIG. 6*a* to FIG. 6*b*, the car decorative illumination lamp or household ceiling lamp includes a basket-shaped lamp housing 800, multiple fluorescence-like LED illumination units 810 exist, the multiple fluorescence-like LED illumination units 810 are arranged in the lamp housing 800, and a light distribution lampshade 200*c* is mounted at an opening of the lamp housing 800.

The fluorescence-like LED illumination unit 810 is formed by a plate-like radiator 100*c*, a bar-shaped light converging Fresnel lens 500, and an LED substrate 400. The plate-like radiator 100*c* is made of an aluminium alloy material. A bar-shaped reflective bowl 160 is mounted on an inner surface 110*c* of the plate-like radiator 100*c* and in an axial direction of the plate-like radiator 100*c*, and an inner surface of the bar-shaped reflective bowl 160 is a paraboloid 161 with reflective effect. The LED substrate 400 is mounted on the inner surface 110*c* of the plate-like radiator 100*c*, and a heat conductive adhesive is used on a bonding surface between the LED substrate 400 and the inner surface 110*c* of the plate-like radiator 100*c* for heat conduction.

The LED substrate 400 extends axially along the radiator 100*c*, and the LED substrate 400 may be one piece or formed by multiple pieces connected in series. Multiple LED illuminants 410 are encapsulated on the LED substrate 400. The LED illuminants 410 are preferably high-power patch LEDs currently commercially available, and may also be conventional low-power in-line LED illuminants according to different energy configuration requirements of lamps. On the inner surface 110*c* of the radiator 100*c*, multiple mounting posts 130 are disposed in a spaced arrangement axially along the radiator 100*c*, and the bar-shaped light converging Fresnel lens 500 is fixed on the mounting posts 130 by screws. The bar-shaped Fresnel lens 500 radially converging light but blending greatly diffused light axially not only can converge light but also can eliminate obvious light spots, which, together with light distribution lampshades 200*c* of different light distribution performance, completely solves the problems such as exposure of spotted light sources, overlapping projections formed by irradiation with a multi-point light source, dazzling light rays, and the like in the existing LED car decorative illumination lamp or ceiling lamp, and achieves luminous intensity, view angle, and efficiency far exceeding those of LED car decorative illumination lamps or ceiling lamps of the same kind.

To improve the heat dissipation effect of the radiator 100*c*, the radiator 100*c* may also be designed as the lamp housing 800, and a heat conductive adhesive is used directly between the inner surface of the radiator 100*c* and the LED substrate 400 for heat conduction.

Embodiment 6

Figure 7A:
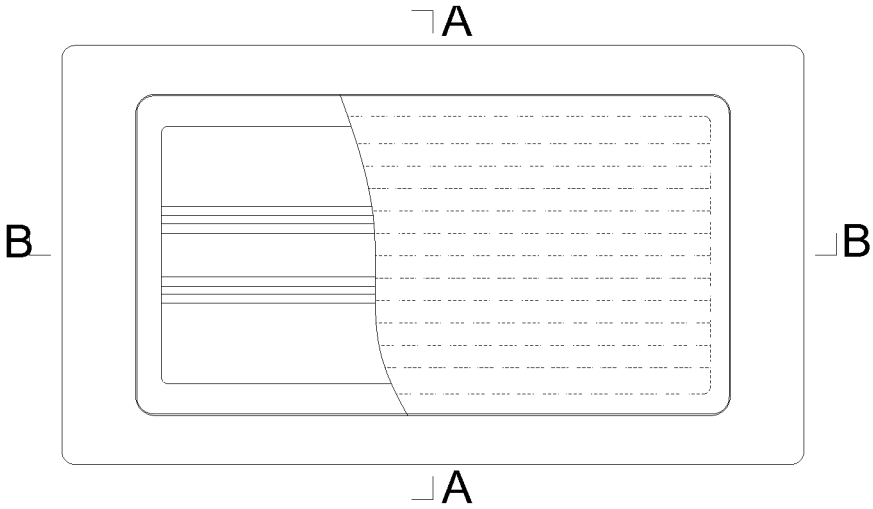
FIG. 7*a* is a schematic front view of a road lamp light emitting unit in the present invention.
Figure 7B:
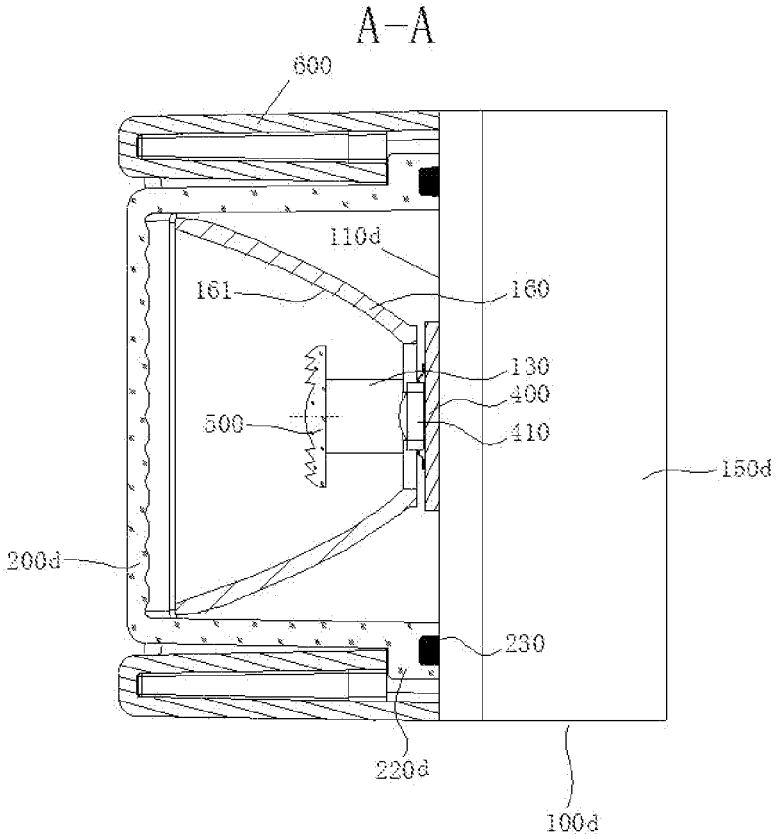
FIG. 7*b* is an A-A sectional view of FIG. 7*a*.
Figure 7C:
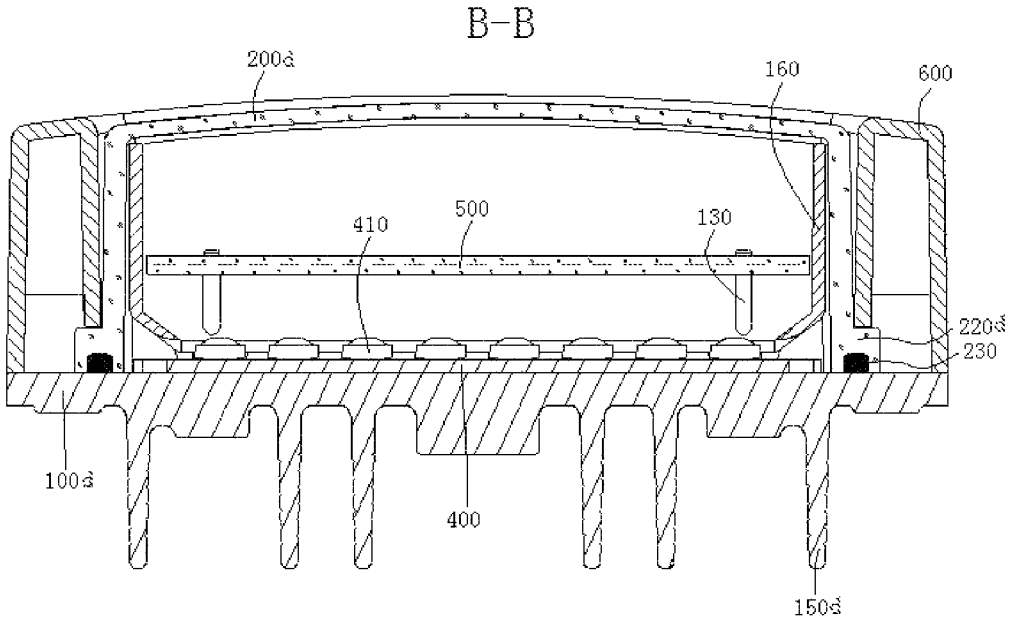
FIG. 7*c* is a B-B sectional view of FIG. 7*a*.

Referring to FIG. 7*a* to FIG. 7*c*, a road lamp light emitting unit of the present invention is formed by a plate-like radiator 100*d*, a bar-shaped light converging Fresnel lens 500, an LED substrate 400, and a light distribution lampshade 200*d*. The plate-like radiator 100*d* is made of an aluminium alloy material. A bar-shaped reflective bowl 160 is mounted on an inner surface 110*d* of the plate-like radiator 100*d* and in an axial direction of the plate-like radiator 100*d*, and an inner surface of the bar-shaped reflective bowl 160 is a paraboloid 161 with reflective effect. The LED substrate 400 is mounted on the inner surface 110*d* of the plate-like radiator 100*d*, and a heat conductive adhesive is used on a bonding surface between the LED substrate 400 and the inner surface 110*d* of the plate-like radiator 100*d* for heat conduction.

The LED substrate 400 extends axially along the radiator 100*d*, and the LED substrate 400 may be one piece or formed by multiple pieces connected in series. Multiple LED illuminants 410 are encapsulated on the LED substrate 400. The LED illuminants 410 are bat-shaped light source LEDs or LED illuminants encapsulated by bat-shaped optical LED lenses. On the inner surface 110*d* of the radiator 100*d*, multiple mounting posts 130 are disposed in a spaced arrangement axially along the radiator 100*d*, and the bar-shaped light converging Fresnel lens 500 is fixed on the mounting posts 130 by screws. The bar-shaped Fresnel lens 500 radially converging light but blending greatly diffused light axially not only can converge light but also can eliminate obvious light spots, which, together with light distribution lampshades 200*d* of different light distribution performance, for example, the light distribution lampshade 200*d* having no stripes or having fine stripes thereon, completely solves the problems such as exposure of spotted light sources, overlapping projections formed on the ground by irradiation with a multi-point light source, dazzling light rays, and the like in some existing LED road lamp illuminants, and achieves luminous intensity and light utilization efficiency far exceeding those of LED road lamp products of the same kind The light distribution lampshade 200*d* is of a basket-shaped structure. A pressed edge 220*d* is arranged on the periphery of the light distribution lampshade 200*d*, and the pressed edge 220*d* is pressed on the radiator 100*d* by a pressing ring 600; a sealing strip 230 for sealing a seam between the pressed edge 220*d* and the radiator 100*d* is disposed on the pressed edge 220*d* for preventing water from entering the light distribution lampshade 200*d*.

To improve the heat dissipation effect of the radiator 100*d*, heat dissipation fins 150*d* are disposed on an outer surface of the radiator 100*d*. Certainly, the radiator 100*d* may also be designed as a lamp housing of the road lamp, and a heat conductive adhesive is used directly between the inner surface of the radiator 100*d* and the LED substrate 400 for heat conduction.

The above embodiments show and describe the basic principle, main features, and advantages of the present invention. Persons skilled in the art should understand that, the present invention is not limited to the above embodiments, the above embodiments and the specification merely describe the principle of the present invention, and the present invention can further be applied in the field of LED lamps of other functions without departing from the spirit and scope of the present invention. The variations and improvements all fall into the scope of the present invention for which protection is sought. The scope for which protection is sought by the present invention is defined by the claims and equivalents thereof.

What is claimed is:

1. A fluorescence-like light emitting diode (LED) illumination unit, comprising a radiator, a LED substrate fixed on an inner surface of the radiator and extending axially along the radiator, and multiple LED illuminants arranged axially along the radiator and encapsulated on the LED substrate, in which the inner surface of the radiator is in the shape of a paraboloid with reflective effect, a bar-shaped convex lens with radial converging effect is disposed in the space surrounded by the paraboloid with reflective effect on the inner surface of the radiator, the bar-shaped convex lens is located in front of the multiple LED illuminants and extends axially along the radiator, and the bar-shaped convex lens radially converges part of light rays emitted by the multiple LED illuminants but axially diffuses them.

2. The fluorescence-like LED illumination unit according to claim 1, wherein the bar-shaped convex lens is located near a location in front of the LED illuminants with light converging effect for the LED illuminants.

3. The fluorescence-like LED illumination unit according to claim 1, wherein the bar-shaped convex lens is a bar-shaped light converging Fresnel lens.

4. The fluorescence-like LED illumination unit according to claim 1, wherein heat dissipation fins are disposed on an outer surface of the radiator.

5. The fluorescence-like LED illumination unit according to claim 1, wherein multiple mounting posts are disposed in a spaced arrangement axially along the radiator on the inner surface of the radiator, and the bar-shaped light converging convex lens is fixedly mounted on the mounting posts by screws or other means.

6. The fluorescence-like LED illumination unit according to claim 1, wherein a strip-shaped mounting groove for embedding the LED substrate is disposed on the inner surface of the radiator, the LED substrate is embedded in the strip-shaped mounting groove, and multiple mounting posts are arranged in the strip-shaped mounting groove.

7. The fluorescence-like LED illumination unit according to claim 1, wherein the LED illuminants are high-power patch LEDs or conventional low-power in-line LED illuminants required for corresponding colors according to different lamp functions, or bat-shaped light source LEDs, or LED illuminants encapsulated by other special lenses.

8. The fluorescence-like LED illumination unit according to claim 1, wherein the LED illuminants are single-chip or multi-chip LED illuminants.

9. The fluorescence-like LED illumination unit according to claim 1, wherein the fluorescence-like LED illumination unit further comprises a light distribution lampshade connected to the radiator and located in front of the bar-shaped convex lens.

10. The fluorescence-like LED illumination unit according to claim 9, wherein the light distribution lampshade is a transparent lampshade, or a mist soft light lampshade, or a light distribution lampshade having various straight or irregular stripes with light scattering effect distributed on inner and outer surfaces thereof, or any other dedicated light distribution lens.

11. A light emitting diode (LED) daylight lamp manufactured by using the fluorescence-like LED illumination unit according to claim 9, wherein the radiator and the light distribution lampshade of the LED daylight lamp enclose a circular lamp tube, lamp holders are mounted on two ends of the circular lamp tube, the lamp holder has electrodes connected to an external power source, the LED substrate is electrically connected to the electrodes on the lamp holders; slots for mounting the light distribution lampshade are disposed on two sides of the strip-shaped mounting groove, insertion edges are disposed on two axial sides of the light distribution lampshade, and the insertion edges are inserted into the slots from one end of the radiator, so that the light distribution lampshade and the radiator are connected to form the lamp tube.

12. A warning lamp light emitting unit manufactured by using the fluorescence-like LED illumination unit according to claim 9, wherein the radiator of the warning lamp light emitting unit is of a plate-like structure, a bar-shaped reflective bowl is disposed on the inner surface of the radiator, an inner surface of the bar-shaped reflective bowl is in the shape of a paraboloid with reflective effect; the light distribution lampshade is of a basket-shaped structure, a pressed edge is arranged on the periphery of the light distribution lampshade, and the pressed edge is pressed on the radiator by a pressing ring; and a sealing strip for sealing a seam between the pressed edge and the radiator is disposed on the pressed edge.

13. A beacon lamp light emitting unit manufactured by using the fluorescence-like LED illumination unit according to claim 9, wherein the radiator of the beacon lamp light emitting unit is of a plate-like structure, a bar-shaped reflective bowl is disposed on the inner surface of the radiator, an inner surface of the bar-shaped reflective bowl is in the shape of a paraboloid with reflective effect; the light distribution lampshade is of a basket-shaped structure, a pressed edge is arranged on the periphery of the light distribution lampshade, and the pressed edge is pressed on the radiator by a pressing ring; and a sealing strip for sealing a seam between the pressed edge and the radiator is disposed on the pressed edge.

14. A beacon lamp manufactured by using the beacon lamp light emitting unit according to claim 13, wherein the beacon lamp comprises a base and a beacon lamp light emitting unit fixing frame fixed on the base, and multiple beacon lamp light emitting units exist, and are fixed on the beacon lamp light emitting unit fixing frame in an annular arrangement with multiple layers in the vertical direction.

15. A car decorative illumination lamp or household ceiling lamp manufactured by using the fluorescence-like LED illumination unit according to claim 9, wherein the car decorative illumination lamp or household ceiling lamp comprises a basket-shaped lamp housing, multiple fluorescence-like LED illumination units exist, the multiple fluorescence-like LED illumination units are arranged in the lamp housing, and the light distribution lampshade is mounted at an opening of the lamp housing.

16. A road lamp light emitting unit manufactured by using the fluorescence-like LED illumination unit according to claim 9, wherein the radiator of the road lamp light emitting unit is of a plate-like structure, the light distribution lampshade is of a basket-shaped structure, a pressed edge is arranged on the periphery of the light distribution lampshade, and the pressed edge is pressed on the radiator by a pressing ring; a sealing strip for sealing a seam between the pressed edge and the radiator is disposed on the pressed edge; and the multiple LED illuminants used in the road lamp light emitting unit are bat-shaped LED light sources or LED illuminants equipped with other dedicated LED light distribution lenses.

17. The fluorescence-like LED illumination unit according to claim 2, wherein the fluorescence-like LED illumination unit further comprises a light distribution lampshade connected to the radiator and located in front of the bar-shaped convex lens.

18. The fluorescence-like LED illumination unit according to claim 3, wherein the fluorescence-like LED illumination unit further comprises a light distribution lampshade connected to the radiator and located in front of the bar-shaped convex lens.

19. The fluorescence-like LED illumination unit according to claim 4, wherein the fluorescence-like LED illumination unit further comprises a light distribution lampshade connected to the radiator and located in front of the bar-shaped convex lens.

20. The fluorescence-like LED illumination unit according to claim 5, wherein the fluorescence-like LED illumination unit further comprises a light distribution lampshade connected to the radiator and located in front of the bar-shaped convex lens.

* * * * *